US006764352B2

(12) United States Patent
Tsuji

(10) Patent No.: US 6,764,352 B2
(45) Date of Patent: Jul. 20, 2004

(54) CONNECTOR

(75) Inventor: Takeshi Tsuji, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/441,874

(22) Filed: May 20, 2003

(65) Prior Publication Data

US 2003/0220024 A1 Nov. 27, 2003

(30) Foreign Application Priority Data

May 23, 2002 (JP) ..... 2002-149636

(51) Int. Cl.[7] ..... H01R 13/514
(52) U.S. Cl. ..... 439/752; 439/595; 439/744
(58) Field of Search ..... 439/752, 595, 439/596, 912, 744

(56) References Cited

U.S. PATENT DOCUMENTS 5,620,346 A * 4/1997 Okumura ..... 439/752
5,628,652 A * 5/1997 Ohsumi ..... 439/595
5,651,703 A * 7/1997 Sasai ..... 439/752
6,024,605 A * 2/2000 Beck et al. ..... 439/595
6,062,906 A * 5/2000 Tanaka ..... 439/595

FOREIGN PATENT DOCUMENTS

JP 4-102576 4/1992

* cited by examiner

*Primary Examiner*—P. Austin Bradley
*Assistant Examiner*—Edwin A. Leon
(74) *Attorney, Agent, or Firm*—Anthony J. Casella; Gerald E. Hespos

(57) ABSTRACT

Properly inserted terminal fittings (40) are engaged and locked by locks (20) returned to their free states. A retainer (30) mounted into a housing (10) then enters deformation spaces (26) for the locks (20). The retainer (30) presses and deforms the locks (20) from their free states toward the terminal fittings (40). Thus, areas of engagement of the locks (20) and the terminal fittings (40) are increased. Additionally, the degree of the resilient deformation of the locks (20) in the inserting process of the terminal fittings (40) is low and resistance acting when the terminal fittings (40) are inserted is suppressed.

11 Claims, 11 Drawing Sheets

CONNECTOR

BACKGROUND OF THE INVENTION

1. Field of the Invention

The invention relates to a connector for doubly locking terminal fittings.

2. Description of the Related Art

Japanese Unexamined Utility Model Publication No. 4-102576 discloses a connector that performs a function of doubly locking terminal fittings. This connector has a housing formed with cavities for receiving terminal fittings. Each terminal fitting is inserted into the cavity from behind and engages a resiliently deformable lock in the cavity. Forces exerted by the terminal fitting deform the lock. However, the lock resiliently returns to engage and lock the terminal fitting when the terminal fitting reaches a proper insertion position. A front retainer is assembled to the front of the housing in this state, and fasteners of the front retainer fit into deformation spaces for the locks to prevent the locks from deforming out of engagement with the terminal fittings. In this way, the locks directly fasten the terminal fittings and the front retainer indirectly fastens the terminal fittings by preventing the deformation of the locks.

A degree of deformation of the lock toward the deformation space in the above-described connector corresponds to an area of engagement of the lock with the terminal fitting. Accordingly, a larger degree of deformation of the locks may be provided to increase the area of engagement of the terminal fittings and the locks.

However, an increase in the degree of deformation of the lock in the inserting process of the terminal fitting results in an increase in the resilient restoring force that accumulates in the lock is increased. Friction between the lock and the terminal fitting increases accordingly. This leads to an increase in resistance against the insertion of the terminal fitting, and also to buckling of a wire if the inserting operation is performed by gripping the wire. As a result, smooth inserting operation of the terminal fitting is hindered.

The present invention was developed in view of the above problem and an object thereof is to improve the reliability of a terminal fitting locking function without reducing the insertion operability of a terminal fitting.

SUMMARY OF THE INVENTION

The invention relates to a connector with a housing formed with at least one cavity into which at least one terminal fitting is insertable. A lock is formed in each cavity and interferes with the terminal fitting in the process of inserting the terminal fitting into the cavity. The lock deforms during insertion of the terminal fitting into the cavity. However, the lock is restored resiliently to engage and lock the terminal fitting when the terminal fitting reaches or is close to a proper insertion position. The connector also includes a retainer to be assembled with the housing. The retainer presses and deforms the lock toward the corresponding terminal fitting when the retainer is fit into the deformation spaces. The area of engagement of the lock and the terminal fitting is increased by as much as the deformation of the lock caused by the retainer. Accordingly, the degree of the deformation of the lock during insertion of the terminal fittings is low and the resistance that acts when the terminal fitting is inserted is suppressed.

The lock preferably returns toward its free state and engages the terminal fitting to lock the terminal fitting when the terminal fitting reaches a proper insertion position. The lock preferably is pressed by the retainer and is deformed toward the corresponding terminal fittings from the free state when the retainer is fitted into the deformation space.

The retainer preferably enters the deformation space for the lock to prevent the lock from being deformed in a direction to be disengaged from the terminal fitting when the retainer is assembled with the housing.

The housing preferably has a plurality of cavities, and a wall forming a front end of each cavity preferably projects independently of the other cavities. The retainer may have engageable portions that engage and surround the walls forming the front ends of the cavities. Fittable portions are formed on the engageable portions of the retainer and fit into the deformation spaces.

The engageable portions of the retainer surround the walls forming the front ends of the cavities and make no loose movement with respect to the cavities or the terminal fittings inserted into the cavities. Thus, the fittable portions on the engageable portions can securely resiliently deform the locks toward the corresponding terminal fittings without loosely moving with respect to the cavities and/or the terminal fittings.

The fittable portions preferably are thrust into a space between the locks and a corresponding portion of the housing to deform the locks. Accordingly, the locks can be more deformed more reliably and with a greater force.

Each lock preferably is cantilevered forward and an extending end of each lock serves as a locking section engageable with the terminal fitting to lock the terminal fitting.

A lock could be formed with a catch for a disengagement jig, and the catch could extend from a locking section that engages with a terminal fitting. This catch could interfere with the outer surface of the terminal fitting to restrict a degree of resilient deformation of the lock when the lock is deformed from its free state. Contrary to this, the present preferred embodiment has locks that are cantilevered and the extending ends engage the terminal fittings. Thus, the locks have no part comparable to the catch that can interfere with the outer surfaces of the terminal fittings. Therefore, a large degree of deformation of the locks to engage the terminal fittings can be ensured.

Each lock preferably is cantilevered substantially forward and the retainer contacts the locks behind positions of engagement between the locks and the terminal fittings. Additionally, the housing and/or each terminal fitting preferably comprise a displacement preventing portion for preventing a locking section of the lock engageable with the terminal fitting from being displaced toward the corresponding terminal fitting.

A backward pulling force on a terminal fitting creates forces that could cause a lock to buckle so that a portion of the lock between its supporting point of resilient deformation and the position of engagement with the terminal fitting could bend toward the deformation space. However, the retainer of the subject invention contacts the lock from the side of the deformation space between the supporting position of resilient deformation and the position of engagement with the terminal fitting. Thus, the lock undergoes no buckling deformation and cannot bend toward the deformation space. Further, the extending end of the lock is prevented from a displacement in a direction away from the retainer and toward the terminal fitting. Therefore, the retainer is held in contact with the lock and a function of the retainer for preventing a buckling deformation cannot be degraded.

According to a further preferred embodiment, a movable surface substantially facing a side opposite from the deformation space is formed at a side of each lock. A sidewall forming the cavity and arranged along the side of the lock is formed with a receiving surface substantially facing the movable surface, and the movable surface is proximate to or substantially in contact with the receiving surface while the retainer resiliently deforms the locks toward the corresponding terminal fittings.

The cavities are exposed to outside via the clearances between the sidewalls and the sides of the locks. Thus, a leak or opening may occur between the terminal fittings inserted in the adjacent cavities. However, the movable surfaces of the locks come to be proximate to or in contact with the receiving surfaces of the sidewalls in the present invention. Thus, the clearances between the sidewalls and the locks are closed to prevent a leak.

The movable surface preferably is substantially parallel with or converging toward the receiving surfaces in the free unbiased state of the lock where it is not deformed.

The lock and/or the retainer preferably comprise at least one slanted guiding surface for guiding the lock into engagement with the terminal fitting.

The lock preferably has an inverted T-shaped cross section that is transversely symmetrical.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a first embodiment of the invention is described with reference to FIGS. 1 to 9. In the following description, a mating side (e.g. left side in FIGS. 1 to 4) of the connector with a mating connector (not shown) is referred to as the front side. The connector of this embodiment is comprised of a housing 10, a retainer 30 and terminal fittings 40.

The housing 10 is made e.g. of a synthetic resin and cavities 11 are formed in the housing 10 to open in the opposite front and rear ends. The cavities 11 are arranged substantially side by side at upper and lower stages.

Figure 7:
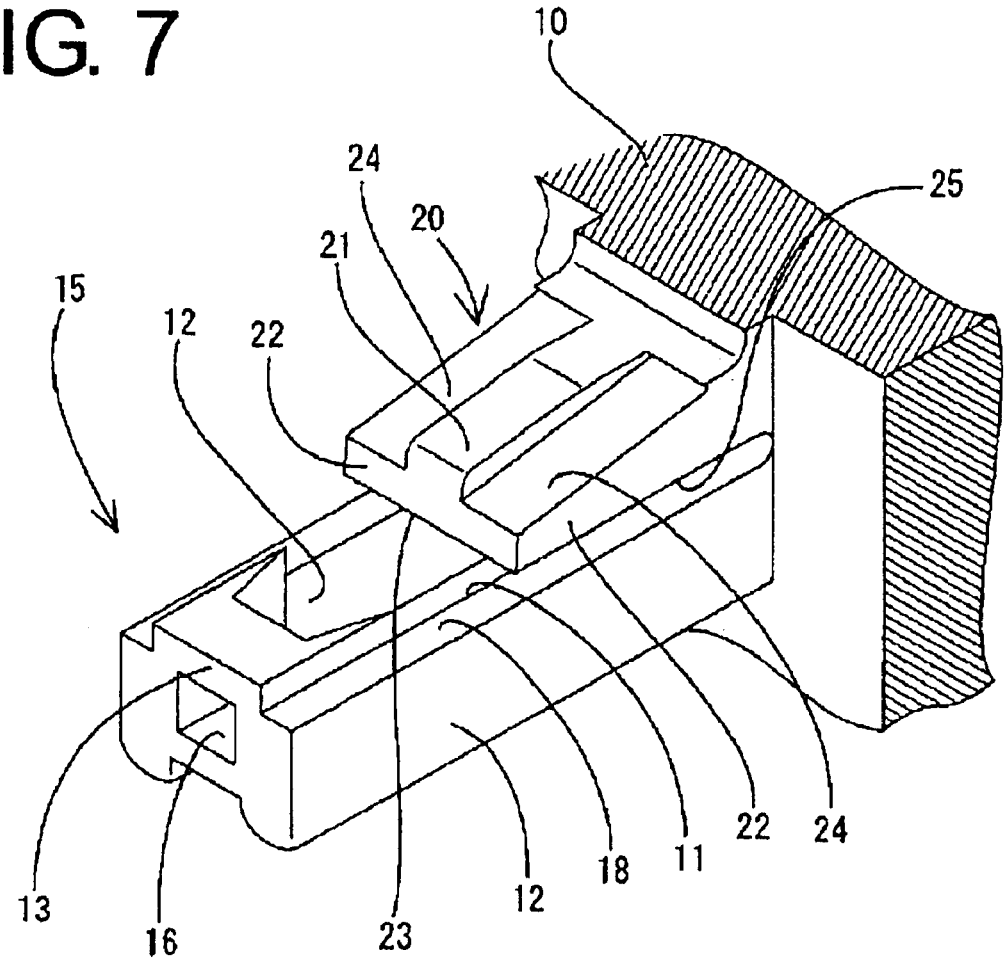
FIG. 7 is a partial enlarged perspective view showing a projecting portion forming a front end portion of a cavity.
Figure 8:
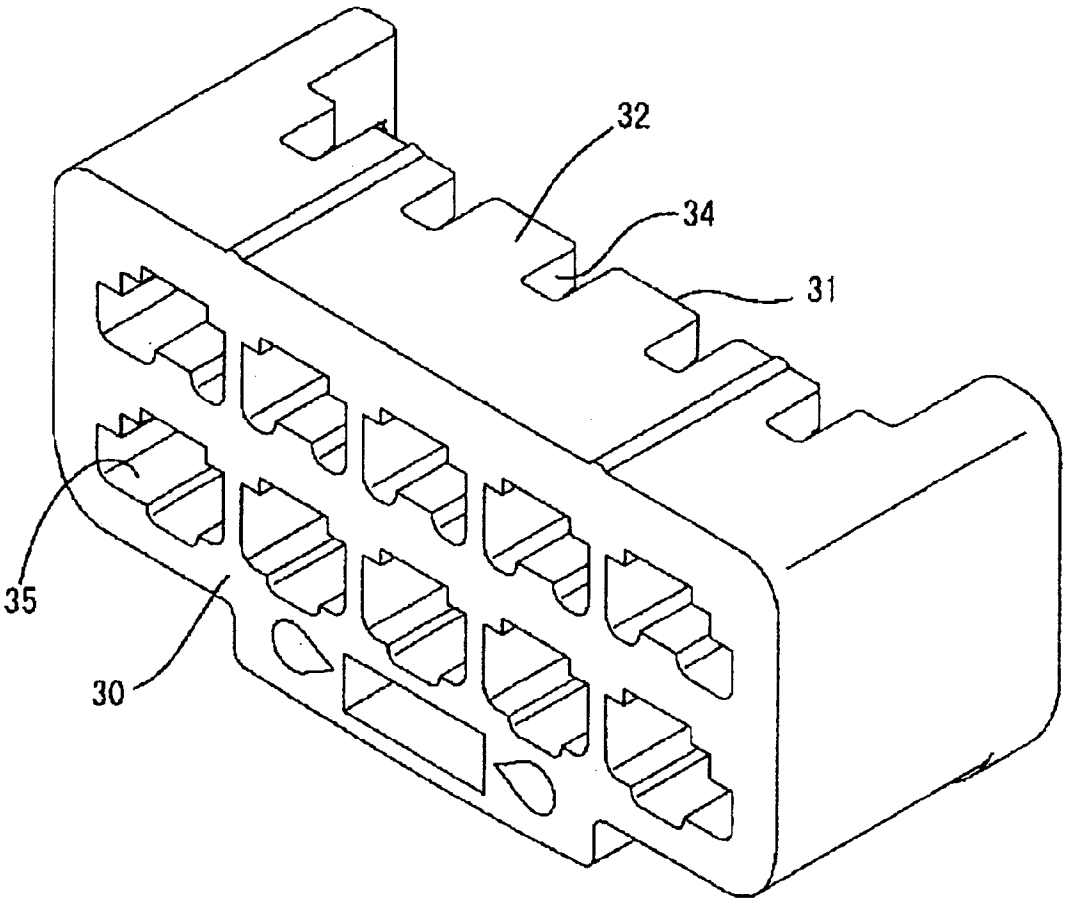
FIG. 8 is a perspective view of the retainer.
Figure 9:
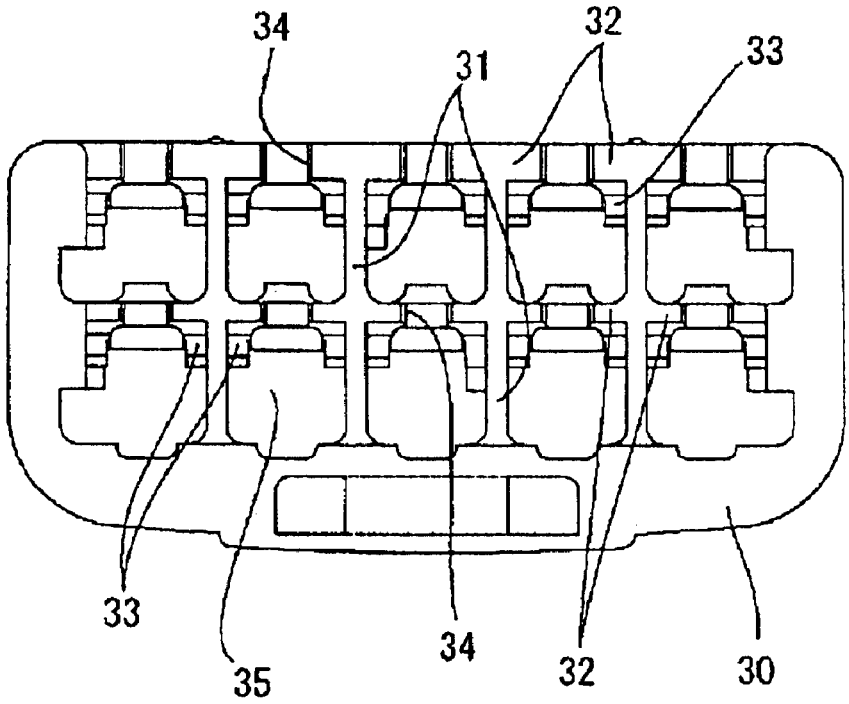
FIG. 9 is a rear view of the retainer.

A front end of each cavity 11 at the upper stage is formed by left and right sidewalls 12 and a front wall 13 that couples the front ends of the opposite sidewalls 12. A front end of each cavity 11 at the lower stage is formed by left and right sidewalls 12, a front wall 13 that couples the front ends of the opposite sidewalls 12, and a bottom wall 14 substantially continuous with the bottom edges of the sidewalls 12 and the front wall 13. The walls forming the front end of each cavity 11 form a projection 15 that projects forward independently of the walls that form the front ends of the other cavities 11, as shown in FIG. 7. Each front wall 13 is formed with a tab hole 16 for permitting a tab 42 of the terminal fitting 40 to project out of the cavity 11.

The upper area between the opposite sidewalls 12 of each projection 15 is open, and a lock 20 formed in the housing 10 substantially covers a rear portion of the opening from above. Slit-shaped clearances extend in forward and backward directions between the left and right side edges of the lock 20 and the upper edges of the sidewalls 12. The upper surface of each sidewall 12 faces the lower surface of the corresponding side end of the lock 20 and defines a receiving surface 18. This receiving surface 18 is substantially parallel with an inserting direction ID of the terminal fitting 40 into the cavity 11. The receiving surface 18 also functions as a displacement-preventing portion for preventing a downward displacement of a locking section 23 at an extending front end of the lock 20.

The locks 20 of the housing 10 cantilever forward substantially along the opening in the upper surface of the corresponding cavity 11 and are resiliently deformable up and down. Each lock 20 has a transversely symmetrical inverted T-shaped cross section when viewed from the front. Thus, each lock 20 has a thick portion 21 with a large vertical dimension at a widthwise middle and thin portions 22 with small vertical dimensions at the left and right sides of the thick portion 21. The lower surfaces of the thick portion 21 and the thin portions 22 are substantially continuous and flush with each other across the lower surface of the lock 20 facing the terminal fitting 40. However, the thick portion 21 projects more up than the thin portions 22 on the upper surface of the lock 20.

The front bottom end of the lock 20 serves as the locking section 23 for engaging and locking the terminal fitting 40. In a free unbiased state of the lock 20, the locking section 23 projects down from the ceiling surface of the cavity 11 and into an insertion space for the terminal fitting 40. Further, the upper surfaces of the thin portions 22 are sloped down to the front and serve as slanted guide surfaces 24.

The lock 20 has a width substantially equal to a distance between the outer surfaces of the sidewalls 12 of the cavity 11, and outer side surfaces of the thin portions 22 are substantially flush with the outer surfaces of the sidewalls 12 when viewed from the front. Movable surfaces 25 face down on the thin portions 22 of the lock 20 and are opposed to the receiving surfaces 18 of the sidewalls 12. The movable surfaces 25 are substantially parallel with the receiving surfaces 18 in the free unbiased state of the lock 20.

A deformation space 26 is defined above the lock 20 in each cavity 11 for permitting an upward deformation of the lock 20. Each deformation space 26 opens at the front end of the housing 10. The deformation spaces 26 for the locks 20 at the lower stage communicate with the cavities 11 at the upper stage in areas corresponding to the thick portions 21 of the locks 20. The locks 20 at the lower stage are positioned to partition the cavities 11 at the upper stage and those at the lower stage.

The retainer 30 is made e.g. of a synthetic resin and is mountable into the housing 10 from the front along a mounting direction MD. The housing 10 is formed with a forwardly open mount space 27 that surrounds the projections 15 and the locks 20. The retainer 30 is mountable at a proper mount position (see FIGS. 1 and 5) where the retainer 30 is accommodated fully in the mount space 27 and a partial mount position (see FIGS. 2 and 4) where the retainer 30 is retracted forward from the mount space 27 in a direction opposite to the mounting direction MD.

Engageable portions 31 are formed at the rear side of the retainer 30 and are individually engageable with the respective projections 15 without shaking in vertical and/or transverse directions. Each engageable portion 31 is substantially a rectangular tube and is engageable in substantially surrounding relationship with the corresponding projection 15. The projections 15 are arrayed vertically and transversely. Thus, the engageable portions 31 define a lattice when seen as an aggregate (see FIG. 9).

Each engageable portion 31 has fittable portions 32 corresponding to the thin portions 22 of each lock 20. The fittable portions 32 form a part of the engageable portion 31 surrounding the projection 15. Slanted pressing surfaces 33 are formed on the lower surfaces of the fittable portions 32 and substantially correspond to the slanted guide surfaces 24 of the lock 20.

The engageable portion 31 is formed with an escaping groove 34 for avoiding an interference with the thick portion 21 of the lock 20. Further, through holes 35 are formed in the retainer 30 and substantially correspond to the tab holes 16 of the cavities 11 for permitting insertion of the tabs 42 of the terminal fittings 40.

The fittable portions 32 are spaced forward from the locks 20 when the retainer 30 is at the partial mount position. However, the fittable portions 32 fit into the respective deformation spaces 26 when the retainer 30 is pushed in the mounting direction MD to the proper mount position. The fittable portions 32 fit into the deformation spaces 26 at the upper stage thrust themselves between the ceiling surfaces of the deformation spaces 26 and the upper surfaces of the thin portions 22 of the locks 20 and the slanted pressing surfaces 33 of the retainer 30 press the slanted guide surfaces 24 of the locks 20 down toward the respective terminal fitting 40. The fittable portions 32 fit into the deformation spaces 26 at the lower stage thrust themselves between the bottom end surfaces of the side walls 12 of the cavities 11 at the upper stage and the upper surfaces of the thin portions 22 and the slanted pressing surfaces 33 of the retainer 30 press the slanted guide surfaces 24 of the locks 20 down toward the respective terminal fitting 40. In this way, the respective locks 20 are pressed down to positions more toward the terminal fittings 40 from their free unbiased states, and are prevented from being deformed in the deformation direction DD toward the deformation spaces 26 up and away from the terminal fitting 40.

Each terminal fitting 40 is formed by bending, folding and/or embossing a metallic plate material stamped or cut out into a specified shape and is narrow and long in forward and backward directions. A substantially rectangular tube 41 is defined at substantially the longitudinal middle of the terminal fitting 40. A tab 42 extends forward from the rectangular tube 41, and a connecting portion 43 is at the rear end of the terminal fitting 40 for crimped, bent or folded connection with a wire 44 or connection with a wire 44 by insulation displacement, soldering, welding or the like. The terminal fitting 40 is inserted into the corresponding cavity 11 from behind and along the insertion direction ID.

An upper cut-away portion 45 extends over substantially the entire width of a part of the upper plate of the rectangular tube 41. Side cut-away portions 46 are formed at the upper ends of the left and right side plates of the rectangular tube 41 at locations aligned with the upper cut-away portion 45. The front edges of the cut-away portions 45, 46 serve as a fastener 47 engageable with the locking section 23 of the corresponding lock 20. The substantially horizontally extending upper edges of the side cut-away portions 46 serve as displacement preventing portions 48 for preventing a displacement of the locking section 23 at the extending end of the lock 20 toward the terminal fitting 40. The displacement preventing portions 48 of the terminal fittings 40 are at substantially the same height as the receiving surfaces 18 of the sidewalls 12 of the cavities 11. With the terminal fitting 40 inserted in the cavity 11, the height of the upper plate of the rectangular tube 41 is higher than the lower surface of unbiased the lock 20 (see FIGS. 1 and 2).

Figure 2:
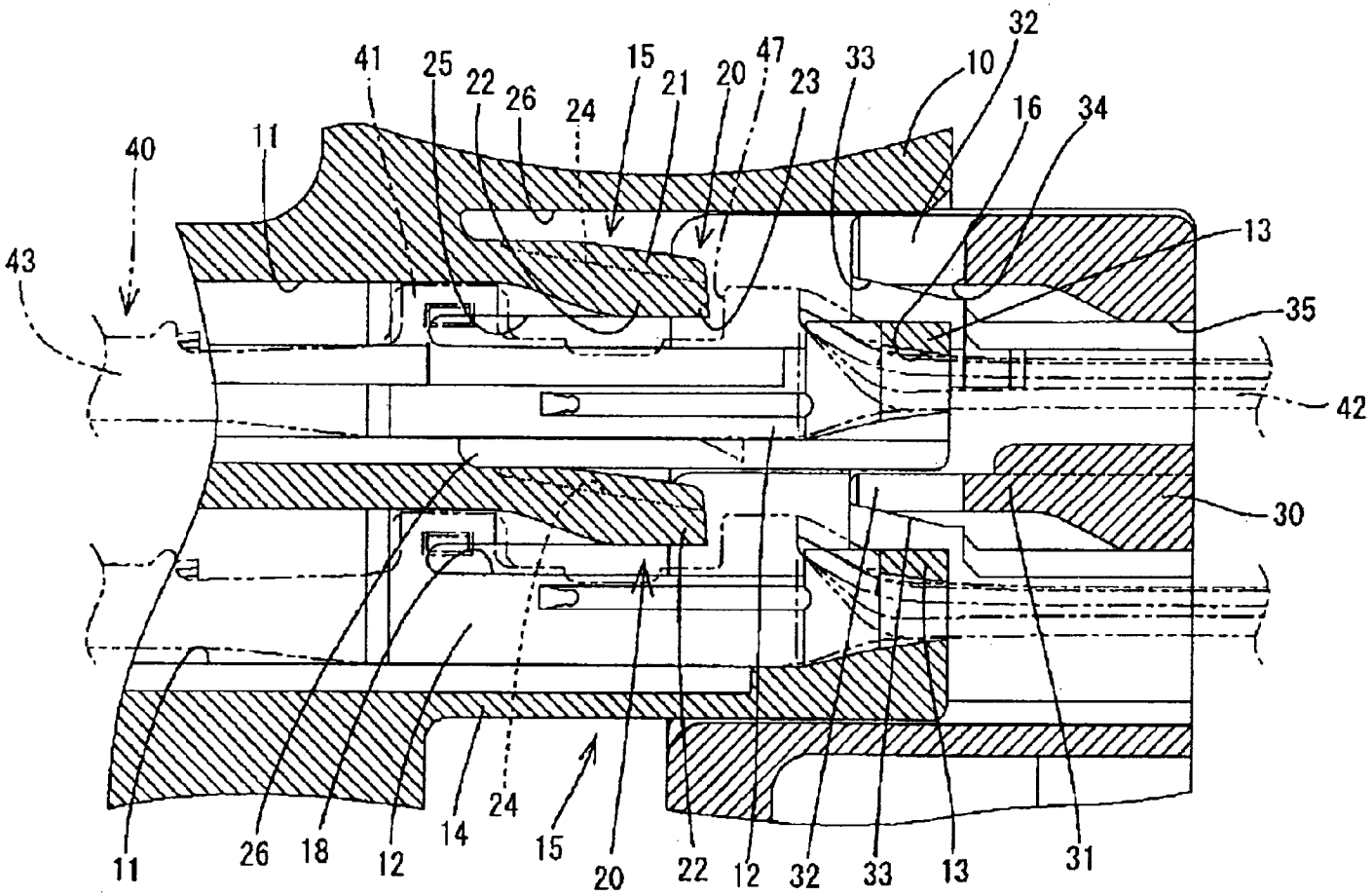
FIG. 2 is a partial enlarged section showing a state where the retainer is mounted at a partial mount position.
Figure 3:
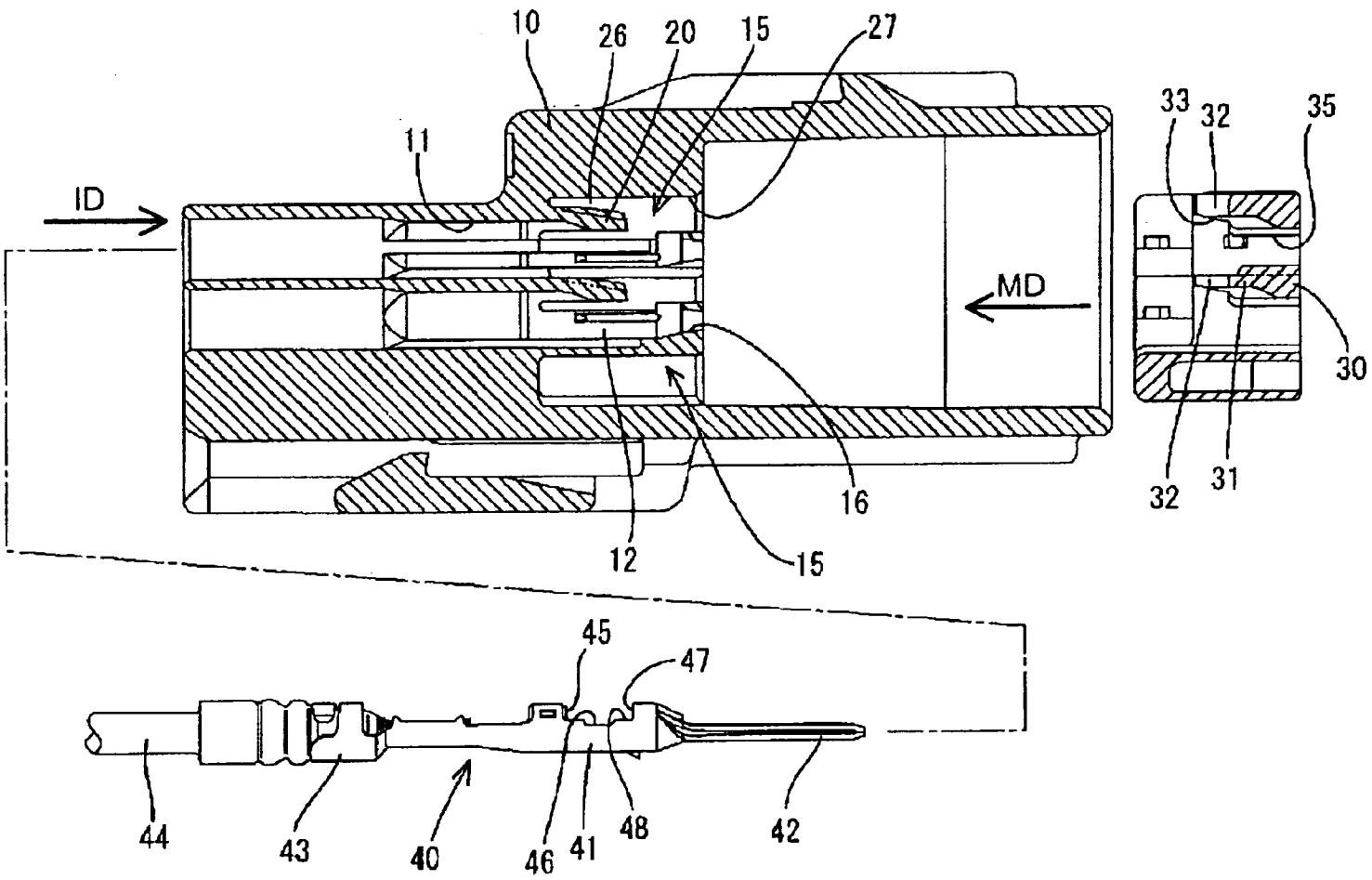
FIG. 3 is an exploded section of the connector.
Figure 4:
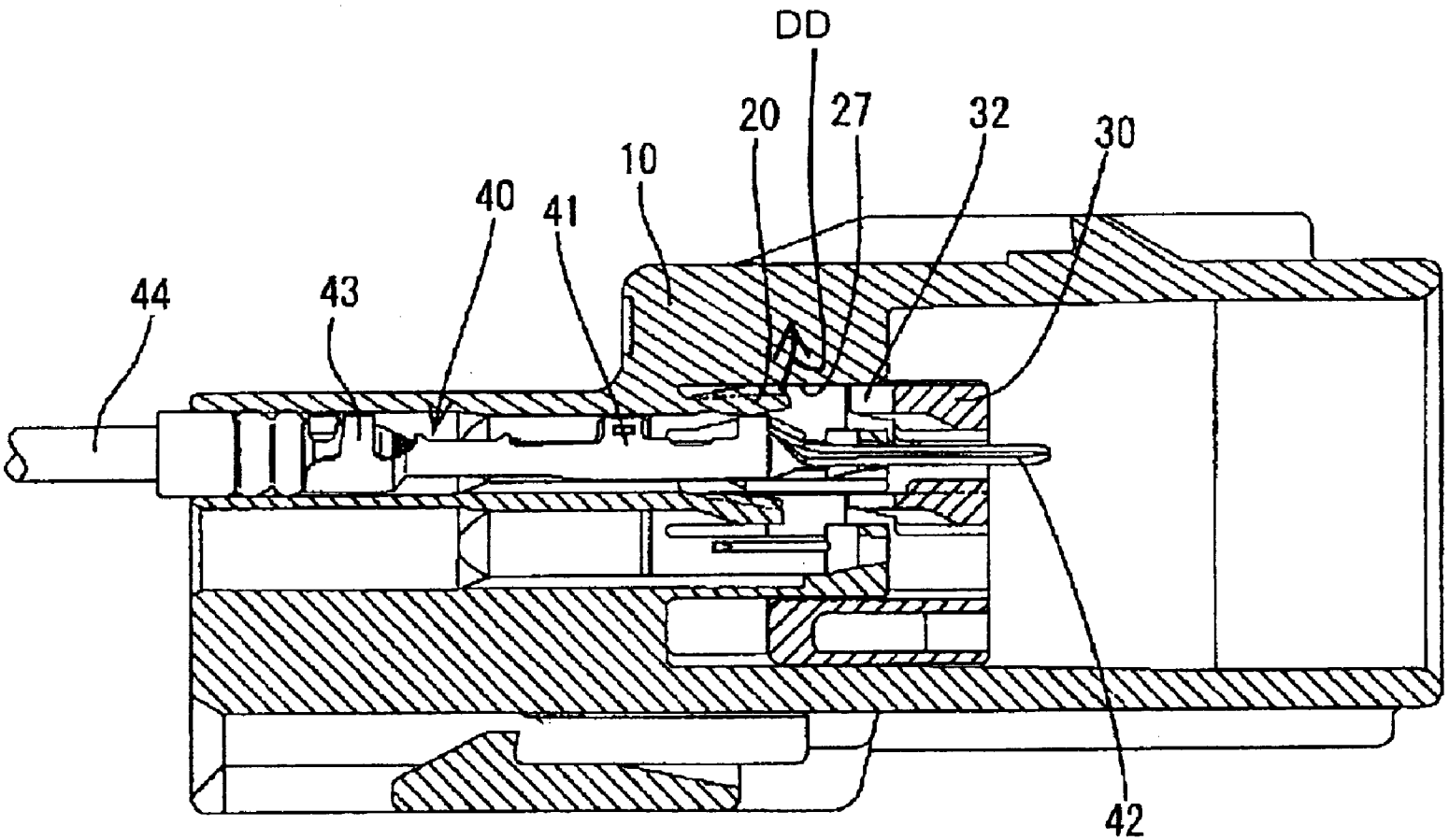
FIG. 4 is a section showing an intermediate stage of insertion of a terminal fitting into a housing.
Figure 5:
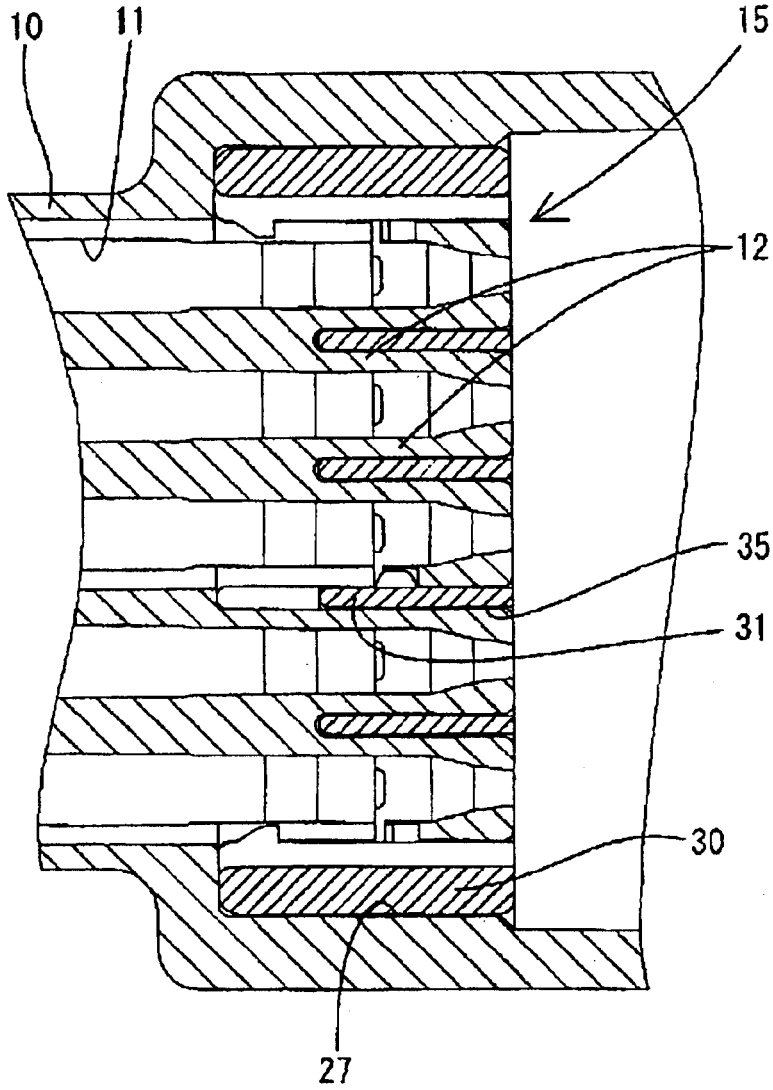
FIG. 5 is a partial enlarged horizontal section showing a state where the retainer is mounted at the proper mount position.
Figure 6:
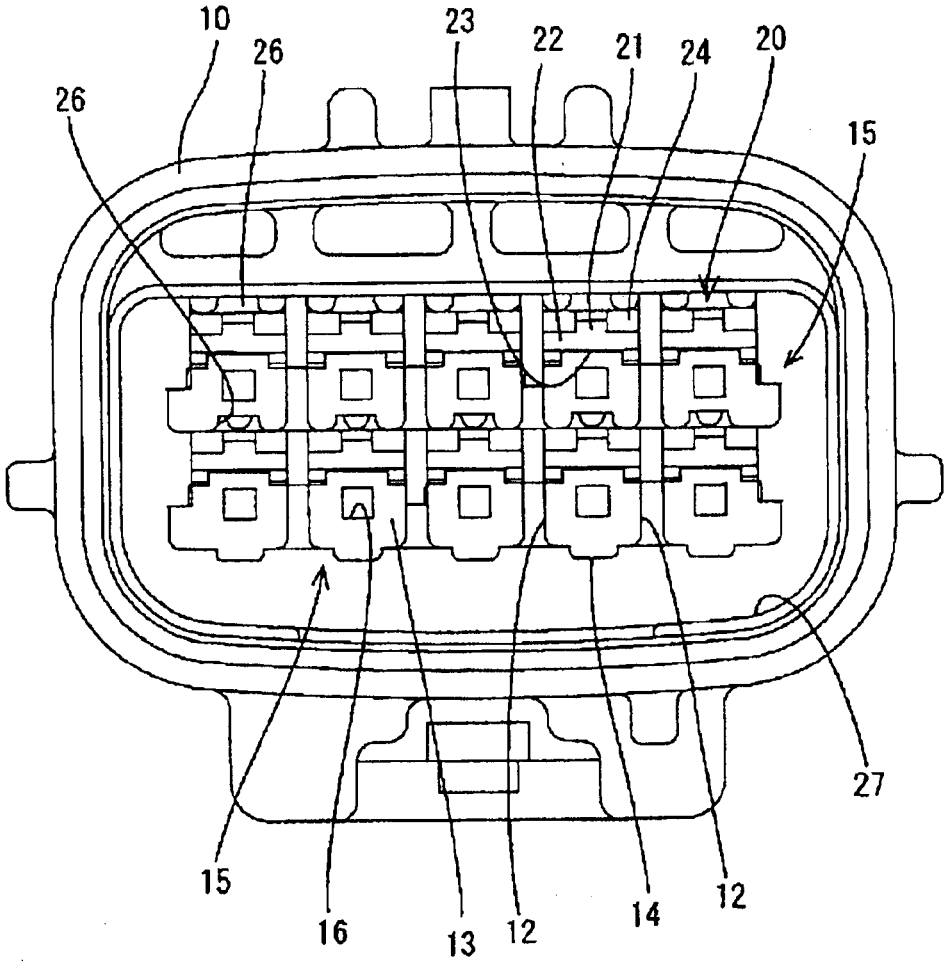
FIG. 6 is a front view of the housing.

The connector is assembled by mounting the retainer 30 in the mounting direction MD to the partial mount position in the housing 10. In this partially mounted state, the fittable portions 32 are spaced forward from the front ends of the lock 20, as shown in FIG. 2, and hence the locks 20 can deform toward the deformation spaces 26. The terminal fittings 40 then are inserted in the inserting direction ID into each cavity 11. The front end of the upper surface of the substantially rectangular tube 41 contacts the lower surface of the lock 20 when the terminal fitting 40 approaches a proper insertion position. Further insertion of the terminal fitting 40 deforms the lock 20 resiliently up in the deformation direction DD and into the deformation space 26 (see FIG. 4).

The lock 20 resiliently moves down in a direction opposite the deformation direction DD when the terminal fitting 40 reaches the proper insertion position and the locking section 23 at the front end of the lock 20 projects into the cut-away portions 45, 46 of the rectangular tube 41 to engage the fastening portion 47 from behind. Thus the lock 20 engages the terminal fitting 40 and prevents the terminal fitting 40 from moving loosely back. Additionally, the rectangular tube 41 engages the front wall 13 of the cavity 11 to prevent the terminal fitting 40 from moving forward beyond the proper insertion position.

The lock 20 is substantially in its free unbiased state when the terminal fitting 40 reaches the proper insertion position and vertical clearances are defined between the locking section 23 of the lock 20 and the displacement preventing portions 48 of the terminal fitting 40 and between the locking section 23 and the receiving surfaces 18. These vertical dimensions of the clearances permit the lock 20 to be deformed down in a direction substantially opposite the deformation direction DD.

Figure 1:
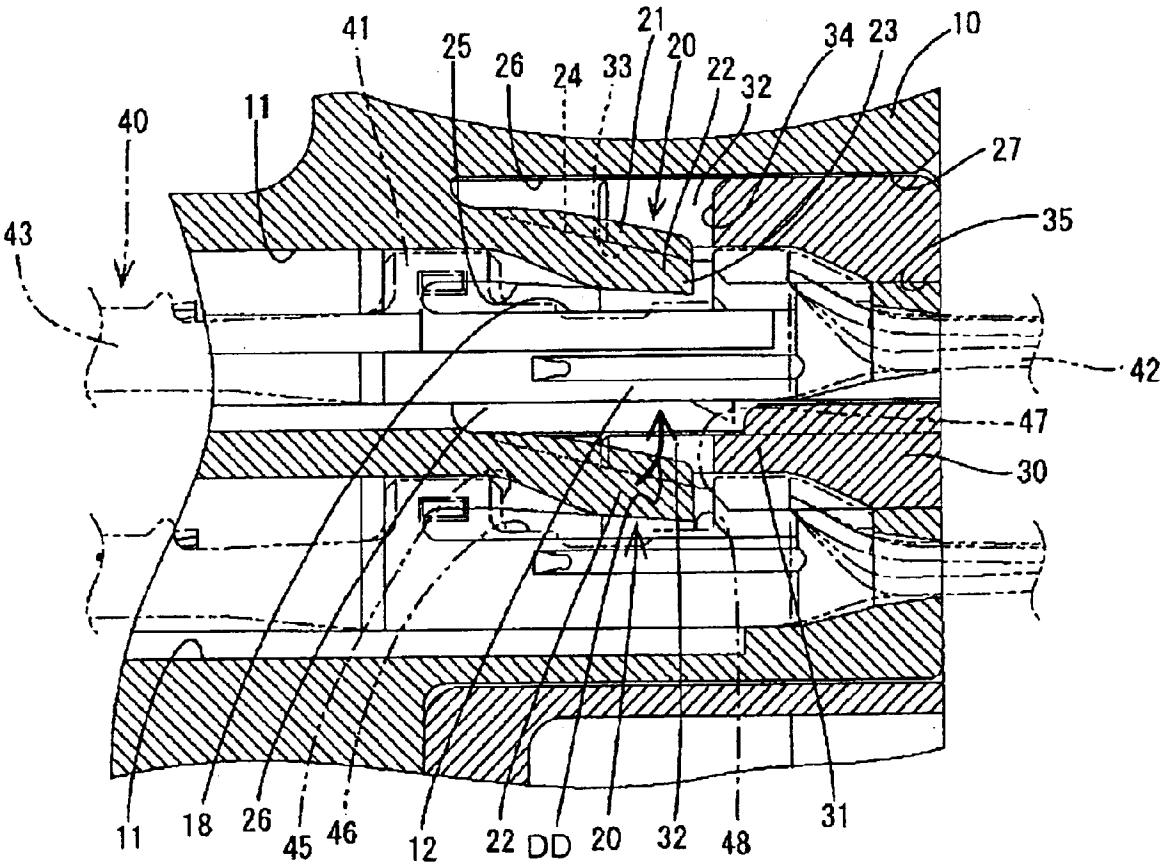
FIG. 1 is a partial enlarged section showing a state where a retainer is mounted at a proper mount position in a connector according to a first embodiment of the invention.

The retainer 30 is pushed in the mounting direction MD from the partial mount position to the proper mount position shown in FIG. 1 after all of the terminal fittings 40 have been inserted. The fittable portions 32 enter the respective deformation spaces 26 in the process of pushing the retainer 30 in the mounting direction MD and the slanted pressing surfaces 33 of the fittable portions contact the slanted guide surfaces 24 of the locks 20. The retainer 30 then is pushed further and the slanted pressing surfaces 33 press the slanted guide surfaces 24 down toward the corresponding terminal fitting 40. As a result, the locks 20 are deformed forcibly from their free unbiased states in a direction opposite the deformation direction DD and toward the terminal fittings 40. Thus, the deformed locks 20 take a posture inclined down to the front distal ends. This displacement of each lock 20 increases a vertical dimension of an area of engagement between the locking section 23 of the lock 20 and the fastening portion 47 of the terminal fitting 40 as compared to a case where the lock 20 is left in its free state (compare FIGS. 1 and 2). The lock 20 has the thin portions 22 pressed from above by the fittable portions 32. Thus, the lock 20 is prevented from being deformed up in the deformation direction DD toward the deformation space 26 and is held engaged with the terminal fitting 40. In this way, the terminal fitting 40 is locked doubly and is prevented securely from coming out.

After the retainer 30 is pushed to the proper mount position, the engageable portions 31 are fit substantially around the respective projecting portions 15 to substantially surround the projecting portions 15 without shaking in vertical and/or transverse directions. Accordingly, the retainer 30 and the fittable portions 32 formed on the engageable portions 31 securely push the locks 20 down to their proper positions without being loosely moved in vertical and/or transverse directions with respect to the housing 10 and the terminal fittings 40.

A backward pulling force could act on the terminal fitting 40 while the lock 20 is engaged with the terminal fitting 40. Such a force could tend to buckle the lock 20 so that a portion of the lock 20 between the locking section 23 and a supporting point at the rear end of the lock 20 could bulge out toward the deformation space 26. However, the retainer 30 of the subject invention presses the locks 20 and inclines the locks 20 down to the front. Thus, the fittable portions 32 of the retainer 30 contacts the upper surfaces of the locks 20 at positions behind the locking sections 23 and forward from the supporting points at the rear ends of the locks 20. Accordingly, the locking sections 23 of the locks 20 are held substantially in contact with the receiving surfaces 18 and the displacement preventing portions 48 and are prevented from downward displacements. Thus, even if a backward pulling force acts on the terminal fitting 40 and the locking section 23, there is no possibility that the lock 20 will buckle.

As described above, areas of engagement of the locks 20 and the terminal fittings 40 are increased by as much as the resilient deformation since the locks 20 in their free states are deformed toward the terminal fittings 40 with the fittable portions 32 of the retainer 30 fit into the deformation spaces 26. Thus, larger areas of engagement of the terminal fittings 40 and the locks 20 can be ensured while the degree of the resilient deformation of the locks 20 in the inserting process of the terminal fittings 40, i.e. resistance resulting from friction between the terminal fittings 40 and the locks 20 when the terminal fittings 40 are inserted is substantially suppressed. In other words, the reliability of the function of locking the terminal fittings 40 is improved without reducing the insertion operability of the terminal fittings 40.

The walls that form the front ends of the cavities 11 form the projections 15 that project independently of the other cavities 11. The retainer 30 is formed with the engageable portions 31 that engage and surround the projections 15 without shaking, and the engageable portions 31 are formed with the fittable portions 32. This prevents the fittable portions 32 from making loose movements with respect to the cavities 11 and the terminal fittings 40, thereby enabling them to deform the locks 20 securely toward the terminal fittings 40.

A lock formed could have a catch for a disengagement jig. The catch could extend from a lock that is engageable with a terminal fitting, and may interfere with the outer surface of the terminal fitting to restrict a degree of resilient deformation of the lock when the lock is deformed resiliently from in its free state. However, in this embodiment, the locks 20 are cantilevered and the locking sections 23 engageable with the terminal fittings 40 are formed at their extending ends. Thus, the locks 20 have no part comparable to the catches that can interfere with the outer surfaces of the terminal fittings 40. Therefore, a large degree of resilient deformation of the locks 20 to engage the terminal fittings 40 can be ensured.

Figure 10:
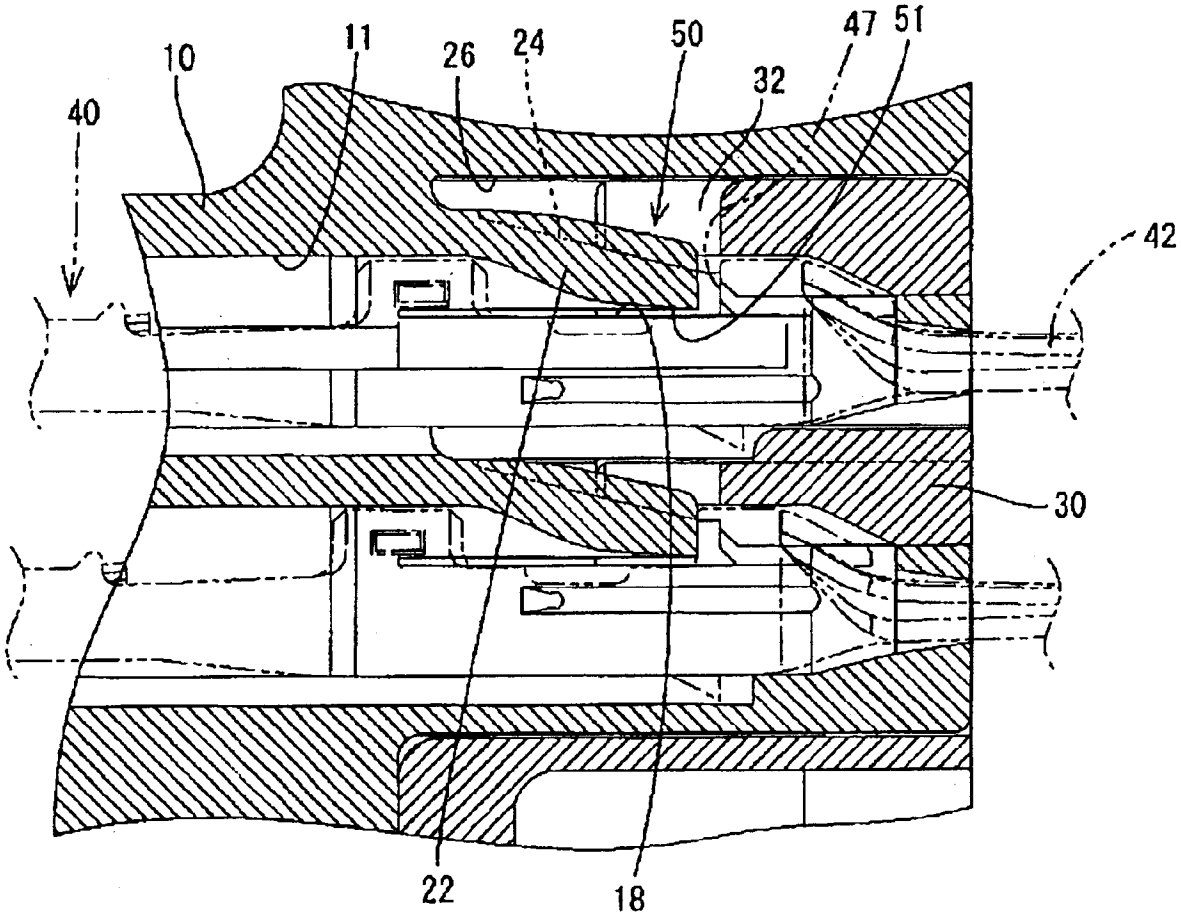
FIG. 10 is a partial enlarged section showing a state where a retainer is mounted at a proper mount position in a connector according to a second embodiment of the invention.
Figure 11:
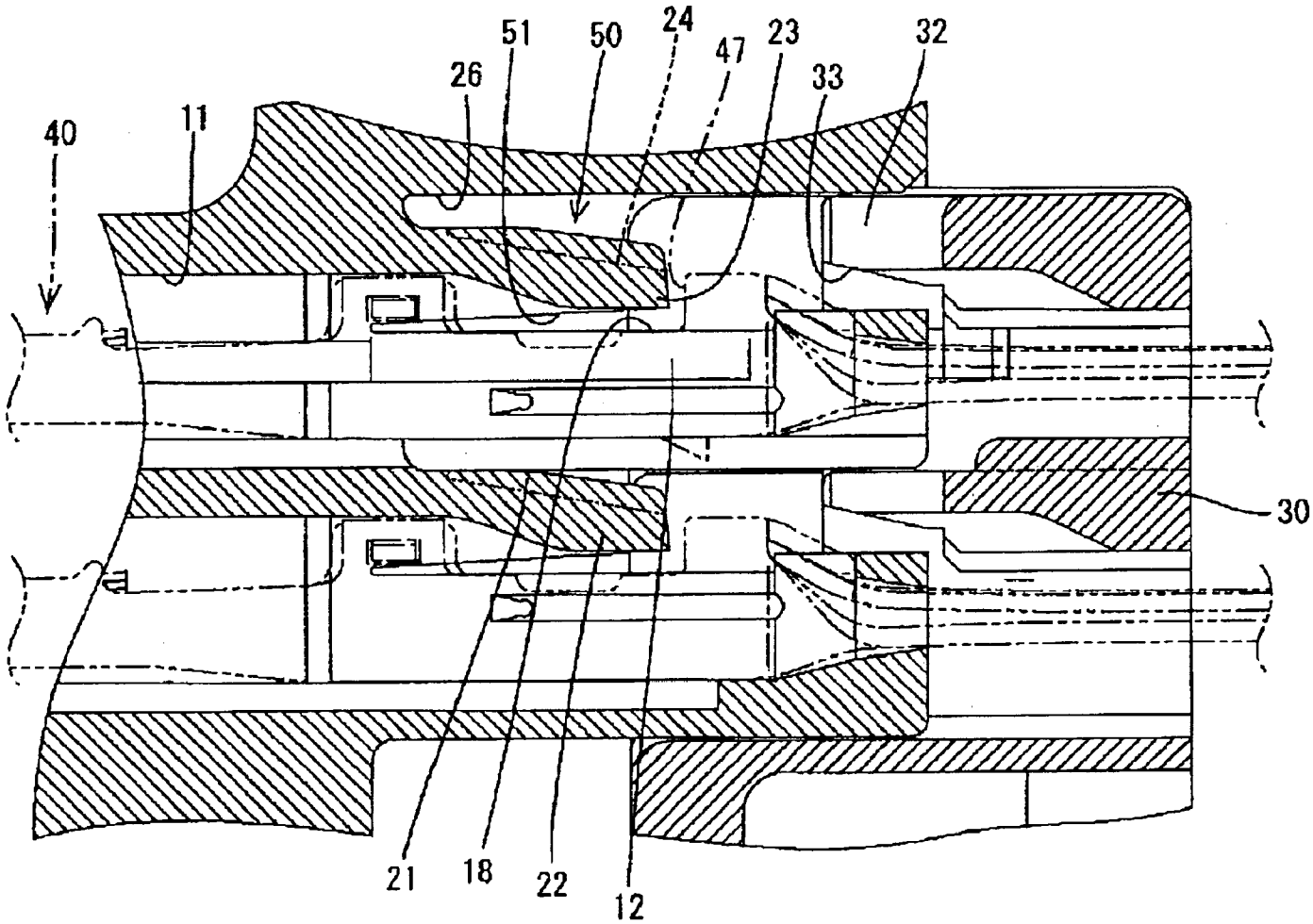
FIG. 11 is a partial enlarged section showing a state where the retainer is mounted at a partial mount position.

A second embodiment of the invention is described with reference to FIGS. 10 and 11. The second embodiment differs from the first embodiment in the construction of movable surfaces 51 at the opposite side ends of each lock 50. The moving surfaces 25 of the locks 20 are substantially parallel with the receiving surfaces 18 of the housing 10 in the free state of the locks 20 where they are not resiliently deformed in the first embodiment. However, the movable surfaces 51 of the second embodiment are sloped up to the front. Accordingly, in the free state of the lock 50, a vertical distance between the receiving surfaces 18 and the movable surfaces 51 increases toward the front extending end of the lock 50. With the fittable portions 32 of the retainer 30 fitted into the deformation spaces 26 and the locks 50 forcibly resiliently deformed toward the terminal fittings 40, the movable surfaces 51 are substantially parallel with the receiving surfaces 18. Further, the movable surfaces 51 are proximate to the receiving surfaces 18 while defining a small clearance to the receiving surfaces 18.

As also described in the first embodiment, the front ends of the cavities 11 are exposed to outside via the clearances between the receiving surfaces 18 at the upper ends of the side walls 12 and the movable surfaces 51 at the opposite sides of the locks 50. Thus, a leak may occur between the terminal fittings 40 of the adjacent cavities 11 by these clearances. However, in the second embodiment, the movable surfaces 51 of the locks 50 are proximate to the receiving surfaces 18 over substantially their entire length while the locks 50 are resiliently deformed toward the terminal fittings 40 by the retainer 30. Thus, the clearances between the sidewalls 12 and the locks 50 are substantially closed, thereby preventing leaks.

Upon forming the movable surfaces 51 oblique to the receiving surfaces 18, the thickness of the locks 50 is increased toward the rear ends as compared to the locks 20 of the first embodiment. Thus, the strength of the locks 50 is enhanced by as much as the increased thickness.

Small clearances still remain between the movable surfaces 51 and the receiving surfaces 18 when the retainer 30 in the second embodiment deforms the locks 50. However, wide areas of the movable surfaces 51 excluding a supporting point of resilient deformation (rear end) of the lock 50 may be held substantially in contact with the receiving surface 18.

Since the other construction is similar or the same as in the first embodiment, no description is given on the structure, functions and the effects thereof by identifying it by the same reference numerals.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The retainer is mounted into the housing from the front in the foregoing embodiments. However, the invention is also applicable to connectors where a retainer is mounted in a direction that intersects the inserting direction ID of the terminal fittings.

The walls that form the front ends of the cavities project like towers independently of the other cavities in the foregoing embodiments. However, the invention is also applicable to connectors in which adjacent cavities are partitioned by common partition walls.

A male connector with male terminal fittings and tabs is described in the foregoing embodiments. However, the invention is also applicable to connectors with female terminal fittings and no male tab.

The extending ends of the locks engage the terminal fittings in the foregoing embodiments. However, a projection may be formed behind the extending end of the lock and this projection may engage the terminal fitting.

The locks are wider than the cavities and face the side walls of the cavities in the foregoing embodiments. However, the locks may have a narrower width and may be accommodated in the cavities according to the invention.

What is claimed is:

1. A connector, comprising:

a housing formed with at least one cavity into which at least one terminal fitting is insertable in an inserting direction, a resiliently deformable lock for each said cavity, the resiliently deformable lock having a free state in which at least a portion of the lock projects at least partially into the cavity and the lock being configured to be deformed by the terminal fitting away from the cavity and into a deformation space in the process of inserting the terminal fitting into the cavity, the lock returning resiliently to the free state after the terminal fitting substantially reaches a proper insertion position and being configured for engaging and locking the terminal fitting when the terminal fitting substantially reaches the proper insertion position; and a retainer to be assembled with the housing, the retainer being configured to fit into the deformation space and to press and resiliently deform the lock from the free state and away from the deformation space toward the corresponding terminal fitting.

2. The connector of claim 1, wherein the retainer enters the deformation spaces for the lock to prevent the lock from being deformed in a direction to be disengaged from the terminal fittings when the retainer is assembled with the housing.

3. The connector of claim 1, wherein the lock is a cantilever and has an extending end that defines a locking surface engageable with the terminal fitting to lock the terminal fitting.

4. The connector of claim 1, wherein the housing has a plurality of cavities, a movable surface facing a side substantially opposite from the deformation space is formed at an end of each lock, a side wall forming each of the cavities and arranged along a side of the respective lock being formed with a receiving surface facing the movable surface, and the movable surface being substantially in contact with the receiving surface while the retainer resiliently deforms the locks toward the corresponding terminal fittings.

5. The connector of claim 1, wherein the lock and the retainer comprise at least one slanted guiding surface for guiding the lock into engagement with the terminal fitting.

6. The connector of claim 1, wherein the lock has an inverted T-shaped cross-section.

7. The connector of claim 1, wherein the housing has a plurality of cavities, a wall forming a front end of each cavity projects independently of the other of said cavities, the retainer being formed with engageable portions engaging and surrounding the wall forming the front ends of the cavities.

8. The connector of claim 7, wherein fittable portions are formed on the engageable portions of the retainer and are fittable into the deformation spaces.

9. A connector, comprising:

a housing formed with a plurality of cavities into which a corresponding plurality of terminal fittings are insertable along an inserting direction, a wall forming a front end of each said cavity and projecting independently of the other of said cavities, a resiliently deformable lock in each said cavity and configured to be deformed by the terminal fitting into a deformation space in the process of inserting the terminal fitting into the cavity, the lock being configured for engaging and locking the terminal fitting when the terminal fitting substantially reaches a proper insertion position; and a retainer to be assembled with the housing, the retainer being formed with engageable portions engaging and surrounding the wall forming the front ends of the cavities, the retainer further having fittable portions formed on the engageable portions of the retainer and fittable into the deformation spaces, wherein the fittable portions are thrust into a space between the respective lock and a corresponding portion of the housing to deform the lock resiliently toward the corresponding terminal fitting.

10. A connector, comprising:

a housing having a plurality of cavities into which a corresponding plurality of terminal fittings are insertable along an inserting direction, each of said cavities having a resiliently deformable lock, wherein each of said locks is a cantilever, and each of said locks being configured to be deformed by the terminal fitting into a deformation space in the process of inserting the terminal fitting into the cavity, each said lock being configured for engaging and locking the respective terminal fitting when the terminal fitting substantially reaches a proper insertion position; and a retainer to be assembled with the housing, the retainer being configured to fit into the deformation space for contacting the locks behind positions of engagement between the locks and the terminal fittings for pressing and resiliently deforming the lock towards the corresponding terminal fitting, the housing and each terminal fitting comprising a displacement preventing portion for preventing a locking section of the lock engageable with the terminal fitting from being displaced toward the corresponding terminal fitting.

11. A connector, comprising:

a housing formed with a plurality of cavities into which a corresponding plurality of terminal fittings are insertable along an inserting direction, a resiliently deformable lock in each said cavity and configured to be deformed by the respective terminal fitting into a deformation space in the process of inserting the terminal fitting into the cavity, each said lock being configured for engaging and locking the corresponding terminal fitting when the corresponding terminal fitting substantially reaches a proper insertion position, each said lock having a movable surface facing a side substantially opposite from the deformation space, each said cavity having a side wall arranged along a side of the respective lock, the side wall having a receiving surface facing the movable surface, wherein the movable surface is substantially parallel with the receiving surfaces when the respective lock is in an undeformed free state; and a retainer to be assembled with the housing, the retainer being configured to fit into the deformation space and to press and resiliently deform the lock from the undeformed free state towards the corresponding terminal fitting, wherein the movable surface is substantially in contact with the receiving surface when the retainer resiliently deforms the lock towards the corresponding terminal fittings.

* * * * *